US012286732B2

(12) United States Patent
Hirai et al.

(10) Patent No.: US 12,286,732 B2
(45) Date of Patent: Apr. 29, 2025

(54) PILE FABRIC AND MANUFACTURING METHOD THEREFOR

(71) Applicant: KANEKA CORPORATION, Osaka (JP)

(72) Inventors: Yusuke Hirai, Hyogo (JP); Nobutaka Taoka, Hyogo (JP); Hiroyuki Shinbayashi, Hyogo (JP); Hiroyuki Tokumoto, Osaka (JP)

(73) Assignee: KANEKA CORPORATION, Osaka (JP)

( * ) Notice: Subject to any disclaimer, the term of this patent is extended or adjusted under 35 U.S.C. 154(b) by 364 days.

(21) Appl. No.: 17/720,637

(22) Filed: Apr. 14, 2022

(65) Prior Publication Data

US 2022/0235500 A1 Jul. 28, 2022

Related U.S. Application Data

(63) Continuation of application No. PCT/JP2020/045222, filed on Dec. 4, 2020.

(30) Foreign Application Priority Data

Dec. 25, 2019 (JP) ..... 2019-233718

(51) Int. Cl.
*D04B 1/04* (2006.01)
*D04B 1/02* (2006.01)

(52) U.S. Cl.
CPC ..... *D04B 1/04* (2013.01); *D04B 1/025* (2013.01); *D10B 2331/04* (2013.01); *D10B 2501/044* (2013.01)

(58) Field of Classification Search
CPC .... D04B 1/04; D04B 1/025; D10B 2501/044; D10B 2331/04; D10B 2321/101;
(Continued)

(56) References Cited

U.S. PATENT DOCUMENTS 4,316,924 A 2/1982 Minemura et al.
4,332,585 A 6/1982 Minemura et al.
(Continued)

FOREIGN PATENT DOCUMENTS

EP 0016450 A1 10/1980
EP 150986 A * 8/1985 ..... A41H 41/005
(Continued)

OTHER PUBLICATIONS

Extended European Search Report issued in corresponding European Patent Application No. 20908275.9 dated Sep. 8, 2023 (7 pages).
(Continued)

*Primary Examiner* — Jennifer A Gillett
(74) *Attorney, Agent, or Firm* — Osha Bergman Watanabe & Burton LLP

(57) ABSTRACT

A pile fabric includes a long pile portion and a short pile portion. An average pile length of the long pile portion differs from an average pile length of the short pile portion by 2 mm or more. The long pile portion contains crimped polyester-based fibers in an amount of 60% by weight or more. The short pile portion contains crimped polyester-based fibers in an amount of 60% by weight or more. A crimp removal temperature of the polyester-based fibers of the long pile portion is lower than a crimp removal temperature of the polyester-based fibers of the short pile portion. The crimp removal temperature of the polyester-based fibers of the short pile portion is 90° C. or more and 120° C. or less. Each of the crimp removal temperatures indicates a minimum temperature that satisfies a specific relationship. A method for manufacturing the pile fabric is also provided.

16 Claims, 2 Drawing Sheets

Before application of pressure

(58) Field of Classification Search
CPC .... D06N 3/0009; D06N 3/0077; D06N 3/042; D06N 3/14; D01D 5/253; D02J 13/00; D06C 15/00
USPC ..... 428/92, 93
See application file for complete search history.

(56) References Cited

U.S. PATENT DOCUMENTS

| | | | | |
|---|---|---|---|---|
| 5,834,119 | A * | 11/1998 | Roop | D01D 5/253 428/397 |
| 6,076,242 | A | 6/2000 | Kasaoka et al. | |
| 2005/0019562 | A1* | 1/2005 | Ochi | D04B 1/025 428/364 |
| 2008/0189824 | A1 | 8/2008 | Rock et al. | |
| 2008/0199651 | A1* | 8/2008 | Matsumoto | D06C 23/00 428/89 |

FOREIGN PATENT DOCUMENTS

| | | | |
|---|---|---|---|
| EP | 3822398 | A1 | 5/2021 |
| JP | S53-45488 | A | 4/1978 |
| JP | S56-107044 | A | 8/1981 |
| JP | S60-162857 | A | 8/1985 |
| JP | H4-136241 | A | 5/1992 |
| JP | H5-140860 | A | 6/1993 |
| JP | 2001-181926 | A | 7/2001 |
| JP | 2001-181927 | A | 7/2001 |
| JP | 2004-137659 | A | 5/2004 |
| JP | 2004-308025 | A | 11/2004 |
| JP | 2004-308080 | A | 11/2004 |
| JP | 2007-002343 | A | 1/2007 |
| WO | 2020/012843 | A1 | 1/2020 |

OTHER PUBLICATIONS

Office Action issued in counterpart Chinese Patent Application No. CN 202080040301.0 dated Apr. 26, 2022 (7 pages).
International Search Report issued in corresponding International Application No. PCT/JP2020/045222, mailed Feb. 9, 2021 (5 pages).
Written Opinion issued in corresponding International Application No. PCT/JP2020/045222, mailed Feb. 9, 2021 (3 pages).

* cited by examiner

Before application of pressure

During application of pressure

Before application of pressure

During application of pressure

PILE FABRIC AND MANUFACTURING METHOD THEREFOR

TECHNICAL FIELD

One or more embodiments of the present invention relate to a pile fabric in which polyester-based fibers are used, and a method for manufacturing the pile fabric.

BACKGROUND

Conventionally, pile fabrics (also referred to as "napped fabrics") of artificial furs have been required to have texture and a gloss like those of natural furs. Polyester-based fibers have excellent firmness and low cold setting properties, and thus the use of polyester-based fibers in a pile fabric is being looked into. The term "cold setting" refers to the fixation of the shape of a pile fabric in a deformed state at room temperature in, e.g., storage in the deformed state. When a pile fabric is compressed and packed in, e.g., transportation, the shape of the pile fabric in packing is fixed, and its texture before packing may be hardly restored. Thus, there is a demand for low cold setting properties. Since polyester-based fibers have excellent, low cold setting properties, the polyester-based fibers are less likely to be severely disturbed even when compressed and packed. Thus, marketability of pile fabrics is less likely to be significantly compromised. However, although a pile fabric in which polyester-based fibers are used is excellent in voluminousness and compression recoverability, the polyester-based fibers are insufficiently polished at a temperature at which modacrylic fibers usually used are polished in the production of the pile fabric. Thus, crimps on the polyester-based fibers are not sufficiently removed. Thus, the pile fibers are entangled with each other, which results in a rough feel and a hair split. Consequently, the pile fabric has a feel and an appearance different from those of natural fur.

Thus, Patent Document 1 proposes to improve the crimp removability of polyester-based fibers by adjusting, e.g., a fiber cross-section, fineness, fiber length, crimp frequency, percentage of crimp, and crimp fastness. Patent Document 2 proposes to improve the crimp removability of polyester-based fibers in polishing by crimping the polyester-based fibers after the polyester-based fibers are subjected to heat treatment at 160° C. to 230° C. under conditions in which shrinkage is limited to 1% to 7% in spinning.

PATENT DOCUMENTS

Patent Document 1: JP S60-162857 A

Patent Document 2: JP H05-140860 A

However, a pile fabric in which polyester-based fibers are used still needs to be subjected to polishing at a high temperature close to 200° C., and has a problem of the improvement of crimp removability.

Moreover, since a long pile portion in the pile fabric comes into contact with the human skin, as many crimps as possible need to be removed in the long pile portion so that a good hand feeling is provided. On the other hand, since a short pile portion in the pile fabric provides voluminousness in the entire pile fabric, crimps need to be appropriately left in the short pile portion while the short pile portion has crimp removability. Nonetheless, a pile fabric that has excellent crimp removability while ensuring voluminousness and compression recoverability has not been known at present. Thus, conventional pile fabrics still have room for improvement.

SUMMARY

One or more embodiments of the present invention provide a pile fabric that includes a long pile portion and a short pile portion, has a good appearance, and good voluminousness and compression recoverability, and further has excellent crimp removability. One or more embodiments of the present invention also provide a method for manufacturing the pile fabric.

One or more embodiments of the present invention relate to a pile fabric described below. The pile fabric includes a pile portion. The pile portion includes a long pile portion and a short pile portion. An average pile length of the long pile portion differs from an average pile length of the short pile portion by 2 mm or more. The long pile portion contains crimped polyester-based fibers in an amount of 60% by weight or more. The short pile portion contains crimped polyester-based fibers in an amount of 60% by weight or more. A crimp removal temperature of the crimped polyester-based fibers of the long pile portion is lower than a crimp removal temperature of the crimped polyester-based fibers of the short pile portion. The crimp removal temperature of the crimped polyester-based fibers of the short pile portion is 90° C. or more and 120° C. or less. Each of the crimp removal temperatures indicates a minimum temperature that satisfies the following numerical formula (1):

$$(A-B)/A\times 100<3(\%) \quad (1)$$

where, in the formula (1),

A represents a length of a fiber bundle of the crimped polyester-based fibers of the short pile portion under a load of 4 mg/dtex after the fiber bundle is subjected to dry heat treatment at a predetermined temperature for 60 seconds under a load of 4 mg/dtex, and B represents a length of the fiber bundle of the crimped polyester-based fibers of the short pile portion under no load after the fiber bundle is subjected to the dry heat treatment at the predetermined temperature for 60 seconds under a load of 4 mg/dtex.

One or more embodiments of the present invention also relate to a method for manufacturing the pile fabric that includes polishing at a temperature of 90° C. or more and 160° C. or less.

One or more embodiments of the present invention and the manufacturing method of one or more embodiments of the present invention can provide a pile fabric that includes a long pile portion and a short pile portion, has a good appearance, and good voluminousness and compression recoverability, and further has excellent crimp removability.

DETAILED DESCRIPTION

Figure 1A:
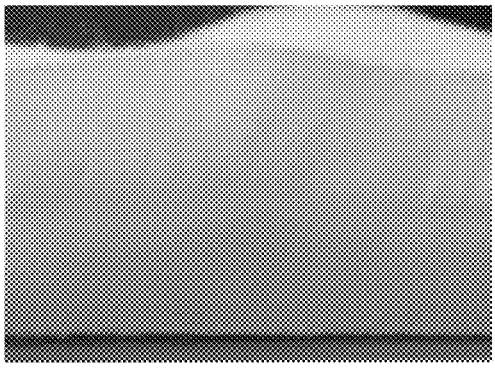
FIGS. 1A, 1B, 1C, and 1D are views illustrating criteria for evaluating the appearance of a pile fabric.

The present inventors conducted intensive studies. As a result of this, the inventors found that a pile fabric with an excellent feel and excellent voluminousness and compression recoverability can be obtained by using, in a pile fabric that includes a long pile portion and a short pile portion, polyester-based fibers as main components of fibers constituting the long pile portion and fibers constituting the short pile portion, and appropriately adjusting the crimp removability of the polyester-based fibers.

In the present disclosure, the term "polyester-based fibers" refers to polyester-based fibers both of the long pile portion and of the short pile portion. The term "polyester-based fibers of the long pile portion" and the term "polyester-based fibers of the short pile portion" in the present disclosure refer to the polyester-based fibers of the long pile portion and the polyester-based fibers of the short pile portion, respectively.

<Pile Fabric>

The long pile portion in the pile fabric contains crimped polyester-based fibers in an amount of 60% by weight or more. The short pile portion in the pile fabric contains crimped polyester-based fibers in an amount of 60% by weight or more. In the present disclosure, a pile portion is a napped portion of the pile fabric other than a base fabric (also referred to as a "ground structure") portion. From the viewpoints of the voluminousness and compression recoverability, the long pile portion contains the crimped polyester-based fibers in an amount of 60% by weight or more, preferably in an amount of 70% by weight or more, and more preferably in an amount of 80% by weight or more of the total weight of the long pile portion, and the short pile portion contains the crimped polyester-based fibers in an amount of 60% by weight or more, preferably in an amount of 70% by weight or more, and more preferably in an amount of 80% by weight or more of the total weight of the short pile portion. Hereinafter, fibers constituting the pile portion are also referred to as "pile fibers".

The pile fabric includes the long pile portion and the short pile portion having different pile lengths. The average pile length of the long pile portion differs from the average pile length of the short pile portion by 2 mm or more. Thus, it is possible to achieve a two-layer structure closely resembling natural fur. In the pile fabric, the average pile length of the long pile portion differs from that of the short pile portion preferably by 5 mm or more and 50 mm or less.

The pile fabric may further include a medium pile portion as well as the long pile portion and the short pile portion. The pile fabric can have an appearance closer to that of natural fur by including the medium pile portion. Also, in such embodiments, it is enough that the average pile length of the long pile portion differs from that of the short pile portion by 2 mm or more. However, in order for the pile fabric to obtain a clearer appearance of a two-layer structure, the average pile length of the long pile portion differs from that of the short pile portion preferably by 5 mm or more and 50 mm or less, and more preferably by 10 mm or more and 50 mm or less.

In one or more embodiments of the present invention, the medium pile portion also contains polyester-based fibers preferably in an amount of 60% by weight or more, more preferably in an amount of 70% by weight or more, and further preferably in an amount of 80% by weight or more of the total weight of the medium pile portion.

In one or more embodiments of the present invention, the average pile length is determined by vertically standing the fibers constituting each pile portion of the pile fabric such that the fibers are aligned, measuring the lengths from the roots of the fibers constituting each pile portion of the pile fabric (roots on the front surface side of the pile fabric) to the tip of each pile portion at 10 sections in each pile portion, and averaging the measured lengths.

In one or more embodiments of the present invention, when a plurality of pile portions having different pile lengths are present, a pile portion having the longest average pile length is referred to as a "long pile portion", and a pile portion having the shortest average pile length is referred to as a "short pile portion". Here, the phrase "pile portions having different pile lengths" means that the average pile lengths of the respective pile portions differ from each other by 2 mm or more.

The pile portion may contain other fibers, e.g., modacrylic fibers and vinyl chloride-based fibers, as well as the polyester-based fibers.

From the viewpoint of being able to obtain soft texture, the long pile portion may contain modacrylic fibers constituted by an acrylic-based copolymer containing acrylonitrile in an amount of 35% by weight or more and less than 95% by weight. It is possible to provide a pile fabric with good texture, recovering strength, and voluminousness by using the polyester-based fibers and the modacrylic fibers in combination.

In one or more embodiments of the present invention, the long pile portion may contain the polyester-based fibers in an amount of 60% by weight or more and 100% by weight or less and the modacrylic fibers in an amount of 40% by weight or less. The long pile portion may contain the polyester-based fibers in an amount of 70% by weight or more and 100% by weight or less and the modacrylic fibers in an amount of 30% by weight or less. The long pile portion may contain the polyester-based fibers in an amount of 80% by weight or more and 100% by weight or less and the modacrylic fibers in an amount of 20% by weight or less.

The acrylic-based copolymer may contain another monomer that is copolymerizable with acrylonitrile in an amount of more than 5% by weight and 65% by weight or less as well as acrylonitrile. The other monomer is not particularly limited, but may be at least one monomer selected from the group consisting of vinyl halides, vinylidene halides, and metal salts of sulfonic acid-containing monomers, and may be at least one monomer selected from the group consisting of vinyl chloride, vinylidene chloride, and sodium styrenesulfonate, for example.

In one or more embodiments of the present invention, the pile fabric can be produced in the same manner as usual pile fabrics except that polishing is performed at a temperature of 90° C. or more and 160° C. or less. For example, a sliver constituted by pile fibers is knitted into a pile fabric (which may be referred to as a "knitted fabric") by a sliver knitting machine, and pre-polishing is performed at a temperature of 90° C. or more and 160° C. or less, and then polishing is performed at a temperature of 90° C. or more and 160° C. or less so that crimps are removed. Polishing may be performed multiple times at different temperatures. Moreover, a back surface (opposite side of the napped portion) of the pile fabric may be coated with a backing resin before polishing in order to eliminate or reduce pile fiber loss and for tentering. The backing resin may be an acrylic acid ester-based adhesive or polyurethane-based adhesive. Further, pre-shearing and shearing may be performed as needed.

<Polyester-Based Fibers>

A polyester-based resin constituting the polyester-based fibers may be, e.g., polyalkylene terephthalate, a copolyester containing polyalkylene terephthalate as the main component, or a combination thereof, but is not particularly limited thereto. Examples of the polyalkylene terephthalate include, but are not particularly limited to, polyethylene terephthalate, polypropylene terephthalate, polybutylene terephthalate, and polytrimethylene terephthalate. In particular, from the viewpoint of heat characteristics, polyethylene terephthalate is preferred. Examples of the copolyester containing polyalkylene terephthalate as the main component include, but are not particularly limited to, copolyesters containing polyalkylene terephthalate such as polyethylene terephthalate, polypropylene terephthalate, polybutylene terephthalate, or polytrimethylene terephthalate as the main component and containing other copolymer components. In particular, the copolyester containing polyethylene terephthalate as the main component is preferred because of its relatively high decomposition temperature (Tg) and excellent handleability. In the present disclosure, the term "main component" refers to a component contained in an amount of 50 mol % or more, and the term "copolyester containing polyalkylene terephthalate as the main component" refers to a copolyester containing polyalkylene terephthalate in an amount of 50 mol % or more. The copolyester containing polyalkylene terephthalate as the main component contains polyalkylene terephthalate preferably in an amount of 60 mol % or more, more preferably in an amount of 70 mol % or more, and further preferably in an amount of 80 mol % or more.

Examples of the other copolymer components include the following: polycarboxylic acids such as isophthalic acid, orthophthalic acid, naphthalenedicarboxylic acid, paraphenylenedicarboxylic acid, trimellitic acid, pyromellitic acid, succinic acid, glutaric acid, adipic acid, suberic acid, azelaic acid, sebacic acid, and dodecanedioic acid, and their derivatives; dicarboxylic acids including a sulfonic acid salt such as 5-sodiumsulfoisophthalic acid and dihydroxyethyl 5-sodiumsulfoisophthalate, and their derivatives; and 1,2-propanediol, 1,3-propanediol, 1,4-butanediol, 1,6-hexanediol, neopentyl glycol, 1,4-cyclohexanedimethanol, diethylene glycol, polyethylene glycol, trimethylolpropane, pentaerythritol, 4-hydroxybenzoic acid, ε-caprolactone, and ethylene glycol ether of bisphenol A. These other copolymer components may be used alone or in combination of two or more.

Specific examples of the copolyester containing polyalkylene terephthalate as the main component include polyesters obtained through copolymerization of polyethylene terephthalate as the main component with at least one compound selected from the group consisting of ethylene glycol ether of bisphenol A, 1,4-cyclohexanedimethanol, isophthalic acid, and dihydroxyethyl 5-sodiumsulfoisophthalate.

The polyalkylene terephthalates and the copolyesters containing polyalkylene terephthalate as the main component may be used alone or in combination of two or more. In particular, it is preferable that the following are used alone or in combination of two or more: polyethylene terephthalate, polypropylene terephthalate, polybutylene terephthalate, polytrimethylene terephthalate, a polyester obtained through copolymerization of polyethylene terephthalate as the main component with ethylene glycol ether of bisphenol A, a polyester obtained through copolymerization of polyethylene terephthalate as the main component with 1,4-cyclohexanedimethanol, a polyester obtained through copolymerization of polyethylene terephthalate as the main component with isophthalic acid, and a polyester obtained through copolymerization of polyethylene terephthalate as the main component with dihydroxyethyl 5-sodiumsulfoisophthalate.

The intrinsic viscosity (IV value) of the polyester-based resin is, although not particularly limited, preferably 0.3 or more and 1.2 or less, and more preferably 0.4 or more and 1.0 or less. When the intrinsic viscosity thereof is 0.3 or more, the mechanical strength of fibers obtained does not decrease. Moreover, when the intrinsic viscosity is 1.2 or less, the molecular weight is not too large, and the melt viscosity is not too high. Thus, it is easy to perform melt spinning, and the fineness of the fibers obtained is likely to be uniform.

For example, an additive agent such as a delustering agent, a lubricant, an antioxidant, a color pigment, a stabilizing agent, a flame retardant, or a toughening agent may be added to the polyester-based resin constituting the polyester-based fibers as needed. The delustering agent may be, e.g., titanium dioxide. Examples of the lubricant include silica microparticles and alumina microparticles.

The cross-sectional shape of the polyester-based fibers is not particularly limited. Examples of the cross-sectional shape include a circular shape and a modified shape. Examples of the modified shape include a Y shape and a flat shape. Examples of the flat shape include an oval shape, a rectangle, a flat multilobed shape, and a flat constriction shape. Examples of the flat constriction shape include shapes having circles or ovals linearly aligned such as a cocoon shape, a four skewered-dumpling shape, and a five skewered-dumpling shape.

From the viewpoint of increasing the voluminousness of the pile fabric, the polyester-based fibers may have a flat shape in which a length (b) of a long side of a fiber cross-section is larger than a length (a) of a short side of the fiber cross-section, and the length (b) of a long side of a fiber cross-section may be not less than two times the length (a) of a short side of the fiber cross-section. From the viewpoint of increasing the voluminousness of the pile fabric, the length (b) of a long side of a fiber cross-section of the polyester-based fibers is, although not particularly limited, preferably not more than eight times, and more preferably not more than six times the length (a) of a short side of the fiber cross-section, for example. The term "long side of a fiber cross-section" refers to a line segment having the maximum length of a fiber cross-section, that is, a line segment having the maximum length, out of straight lines connecting any two points on an outer circumference of the fiber cross-section. The term "short side of the fiber cross-section" refers to a line segment having the maximum width of the fiber cross-section, that is, a line segment having the maximum length, out of straight lines that connect any two points on the outer circumference of the fiber cross-section which are perpendicular to the long side of the fiber cross-section. In the case of a circular shape, the length (b) of the long side of a fiber cross-section is the same as the length (a) of the short side of the fiber cross-section.

The polyester-based fibers have a crimp(s). The term "crimp" refers to a crimp imparted by a known crimp imparting method such as a gear crimping method or a stuffing box method, but is not particularly limited thereto. The crimp frequency of the polyester-based fibers is not particularly limited. From the viewpoints of bulkiness and processability in a carding machine, the crimp frequency may be 5 crimps/25 mm or more and 18 crimps/25 mm or less, or 8 crimps/25 mm or more and 14 crimps/25 mm or less, for example. In one or more embodiments of the present invention, the crimp frequency is measured in accordance with JIS L-1015.

Examples of the form of the crimped polyester-based fibers include, although not particularly limited, a filament form, a staple form, and a tow form in which filaments are bundled together.

<Short Pile Portion>

The polyester-based fibers of the short pile portion have a crimp removal temperature of 90° C. or more and 120° C.

or less. Here, the term "crimp removal temperature" refers to the minimum temperature that satisfies the following numerical formula (1):

$$(A-B)/A\times100<3(\%) \quad (1)$$

where, in the formula (1), A represents the length of a fiber bundle of the polyester-based fibers under a load of 4 mg/dtex after the fiber bundle is subjected to dry heat treatment at a predetermined temperature for 60 seconds under a load of 4 mg/dtex, and B represents the length of the fiber bundle under no load after the dry heat treatment is performed as above.

Specifically, the following will describe how the crimp removal temperature of the polyester-based fibers is measured. First, the polyester-based fibers are bundled to prepare a fiber bundle with 9000 dtex. Both ends of the fiber bundle are trimmed such that the resulting sample has a length of about 200 mm. The sample is suspended vertically in a hot-air convection dryer. A 36 g-weight is suspended from a lower end of the fiber bundle (a load of 4 mg/dtex is applied to the fiber bundle). In this state, the sample is subjected to heat treatment for 60 seconds at a predetermined temperature starting from 50° C. and increasing in increments of 10° C. After each instance of heat treatment, a length A of the fiber bundle under a load of 4 mg/dtex, and a length B of the fiber bundle under no load after the weight has been removed are measured. The measurement thereof is performed five times at each temperature. The differences between the values of A and B are divided by A, and the values thus obtained are averaged. Out of the temperatures, the minimum temperature at which the average is less than 3% is referred to as the "crimp removal temperature". That is, the crimp removal temperature indicates the minimum temperature that satisfies the numerical formula (1).

As above, the crimp removal temperature of the polyester-based fibers of the short pile portion is 90° C. or more and 120° C. or less. Thus, crimps are removed moderately from the polyester-based fibers of the short pile portion in a relatively low temperature range of 90° C. or more and 160° C. or less in polishing that is a step in pile fabric processing. Specifically, only crimps on a napped surface layer portion of the pile fabric are likely to be removed. Thus, it is possible to obtain a pile fabric having a good appearance and excellent voluminousness. If the crimp removal temperature of the polyester-based fibers of the short pile portion exceeds 120° C., crimps are not sufficiently removed in polishing at a low temperature of 90° C. or more and 160° C. or less, and crimps on the pile fibers are hardly removed, resulting in a pile fabric having a poor appearance and feel. On the other hand, if the crimp removal temperature is lower than 90° C., crimps on the pile fibers are almost completely removed in polishing at a low temperature of 90° C. or more and 160° C. or less, resulting in a pile fabric with inferior voluminousness.

When a pressure resistant vessel is filled with the polyester-based fibers of the short pile portion together with pure water while a pressure of 3 kPa or more and 20 kPa or less is applied, and hot-water treatment is performed at 98° C. for 60 minutes, the crimp removal temperature of the polyester-based fibers after the hot-water treatment may be 90° C. or more and 120° C. or less. When the crimp removal temperature of the polyester-based fibers is also 90° C. or more and 120° C. or less even after the hot-water treatment, crimps are removed moderately in polishing at a low temperature of 90° C. or more and 160° C. or less even through a step such as dyeing under hot-water conditions. Specifically, only the crimps on the napped surface layer portion of the pile fabric are likely to be removed. Thus, it is possible to obtain a pile fabric having a good appearance and excellent voluminousness.

The single fiber fineness of the polyester-based fibers of the short pile portion is, although not particularly limited, preferably 12 dtex or less, more preferably 10 dtex or less, further preferably 7 dtex or less, and particularly preferably 5 dtex or less, for example. If the single fiber fineness exceeds 12 dtex, heat is not sufficiently transferred in polishing, and the number of instances of polishing may need to be increased to moderately remove crimps. Moreover, an increase in the number of instances of polishing may deteriorate soft texture. Furthermore, from the viewpoint of fiber handleability, the single fiber fineness of the polyester-based fibers of the short pile portion is, although not particularly limited, preferably 1 dtex or more. When the short pile portion contains other fibers as well as the polyester-based fibers, from the viewpoints of the texture and crimp removability, the single fiber fineness of the other fibers may be 12 dtex or less, 10 dtex or less, 7 dtex or less, or 5 dtex or less. Moreover, from the viewpoint of fiber handleability, the single fiber fineness of the other fibers may be 1 dtex or more.

The polyester-based fibers of the short pile portion can be produced in the same manner as usual polyester-based fibers except that no heat treatment is performed on drawn yarns before crimping, after crimping, or before and after crimping; heat treatment is performed on drawn yarns at a temperature of 25° C. or more and 120° C. or less before crimping, after crimping, or before and after crimping; or heat treatment is performed on drawn yarns at a temperature of 100° C. or more and 200° C. or less before crimping, and heat treatment is performed on the drawn yarns at a temperature of 25° C. or more and 140° C. or less after crimping.

The phrase "before crimping" refers to a time period starting from the completion of drawing polyester-based fibers to the start of crimping. The phrase "after crimping" refers to a time period starting from the completion of crimping until crimped polyester-based fibers are finally obtained. When heat treatment is performed on drawn yarns at 100° C. after crimping, heat treatment at 100° C. is performed in a time period starting from the completion of crimping until crimped polyester-based fibers are finally obtained, for example. Before and after crimping, it is possible to include a step other than the heat treatment, such as oil applying, constant length cutting, or rewinding, for example.

Crystallization of the polyester-based fibers is not facilitated before crimping, after crimping, or before and after crimping by performing no heat treatment on drawn yarns before crimping, after crimping, or before and after crimping; or by performing heat treatment on drawn yarns at a temperature of 25° C. or more and 120° C. or less before crimping, after crimping, or before and after crimping. Therefore, it is possible to obtain polyester-based fibers having a crimp removal temperature of 90° C. or more and 120° C. or less. Moreover, as described above, since these polyester-based fibers are used for the short pile portion of the pile fabric, crimps are moderately removed from the polyester-based fibers in polishing at a low temperature of 90° C. or more and 160° C. or less in the pile fabric processing. Specifically, only the crimps on the napped surface layer portion of the pile fabric are likely to be removed. Thus, it is possible to obtain a pile fabric having a good appearance and excellent voluminousness.

From the viewpoint of reducing the shrinkage percentage of the polyester-based fibers, heat treatment is performed on drawn yarns preferably at a temperature of 25° C. or more and 120° C. or less, more preferably at a temperature of 60° C. or more and 110° C. or less, and further preferably at a temperature of 80° C. or more and 110° C. or less after crimping when no heat treatment is performed before crimping. The heat treatment time may be, e.g., 10 minutes or more and 50 minutes or less, but is not particularly limited thereto. Specifically, heat treatment after crimping is performed preferably at a temperature of 60° C. or more and 110° C. or less for 10 minutes or more and 50 minutes or less, and more preferably at a temperature of 80° C. or more and 110° C. or less for 20 minutes or more and 40 minutes or less. In the case where heat treatment is performed on drawn yarns only after crimping, crimps imparted to the polyester-based fibers may be tightly fixed thereto if the temperature of the heat treatment exceeds 120° C. In this case, there is a possibility that the crimp removal temperature of the polyester-based fibers exceeds 120° C. When the heat treatment time is 50 minutes or less, the productivity and production processability will be improved.

On the other hand, when heat treatment is performed on drawn yarns before and after crimping, heat treatment may be performed on the drawn yarns at a temperature of 100° C. or more and 200° C. or less before crimping, and heat treatment may also be performed on the drawn yarns at a temperature of 25° C. or more and 140° C. or less after crimping. In this case, heat treatment is performed on the drawn yarns preferably at a temperature of 100° C. or more and 170° C. or less, and more preferably at a temperature of 100° C. or more and 150° C. or less, before crimping. In addition, after crimping, heat treatment is performed preferably at a temperature of 25° C. or more and 130° C. or less, and more preferably at a temperature of 25° C. or more and 120° C. or less. For example, the heat treatment time may be 10 seconds or more and 5 minutes or less, and 20 seconds or more and 4 minutes or less before crimping, but is not particularly limited thereto. Moreover, for example, the heat treatment time may be 5 minutes or more and 40 minutes or less, and 10 minutes or more and 30 minutes or less after crimping, but is not particularly limited thereto. The crimp removal temperature of the obtained polyester-based fibers is reduced by subjecting the drawn yarns to heat treatment under the above-described conditions before and after crimping. In particular, when heat treatment is performed on the drawn yarns under the above-described conditions before and after crimping, the obtained polyester-based fibers are also likely to have a crimp removal temperature of 90° C. or more and 120° C. or less even after hot-water treatment. Moreover, crimps are moderately removed in polishing at a low temperature of 90° C. or more and 160° C. or less even through a step such as dyeing under hot-water conditions. Specifically, only the crimps on the napped surface layer portion of the pile fabric are likely to be removed. Thus, it is possible to obtain a pile fabric having a good appearance and excellent voluminousness.

Heat treatment performed before crimping, after crimping, or before and after crimping may be dry heat treatment or wet heat treatment. Dry heat treatment is preferred because the process is simple. It is possible to perform dry heat treatment using, e.g., a uniform hot-air dryer or a suction dryer. The heat treatment may be performed in a relaxed state. The relaxation rate may be set to, e.g., 20% or less, but is not particularly limited thereto.

<Long Pile Portion>

The polyester-based fibers of the long pile portion have a lower crimp removal temperature than the polyester-based fibers of the short pile portion. The long pile portion is located on an outer layer (surface layer) of the pile fabric and comes into contact with the human skin directly. Thus, the long pile portion more exerts influence on a feel. Thus, crimps left in the long pile portion result in a rough feel. On the other hand, the long pile portion less tends to exert influence on the voluminousness of the pile fabric compared to the short pile portion. For these reasons, the crimp removability of the polyester-based fibers of the long pile portion needs to be higher than that of the polyester-based fibers of the short pile portion. In other words, the crimp removal temperature of the polyester-based fibers of the long pile portion needs to be lower than that of the polyester-based fibers of the short pile portion. The crimp removal temperature of the polyester-based fibers of the long pile portion may be 110° C. or less, or 90° C. or less. The crimp removal temperature of the polyester-based fibers of the long pile portion differs from that of the polyester-based fibers of the short pile portion preferably by, e.g., 10° C. or more.

When a pressure resistant vessel is filled with the polyester-based fibers of the long pile portion together with pure water while a pressure of 3 kPa or more and 20 kPa or less is applied, and hot-water treatment is performed at 98° C. for 60 minutes, the crimp removal temperature of the polyester-based fibers after the hot-water treatment may be less than 120° C., 110° C. or less, or 90° C. or less.

Since the crimp removal temperature of the polyester-based fibers of the long pile portion is less than 120° C., crimps are removed well from the polyester-based fibers of the long pile portion in a relatively low temperature range of 90° C. or more and 160° C. or less in polishing, and it is possible to obtain a pile fabric having a good appearance and feel. If the crimp removal temperature is 120° C. or more, crimps are not sufficiently removed in polishing at a low temperature of 90° C. or more and 160° C. or less, and crimps on the pile fibers are hardly removed, resulting in a pile fabric having a poor appearance and feel.

From the viewpoint of easily expressing an appearance of a two-layer structure closely resembling natural fur, the single fiber fineness of the polyester-based fibers of the long pile portion is, although not particularly limited, preferably 10 dtex or more and 50 dtex or less, and more preferably 15 dtex or more and 40 dtex or less, for example. When the long pile portion contains other fibers as well as the polyester-based fibers, from the viewpoint of easily expressing an appearance of a two-layer structure closely resembling natural fur, the single fiber fineness of the other fibers are also preferably 10 dtex or more and 50 dtex or less, and more preferably 15 dtex or more and 40 dtex or less.

<Medium Pile Portion>

In one or more embodiments of the present invention, when the pile fabric includes the medium pile portion, polyester-based fibers having a crimp removal temperature of 120° C. or less can be used for the medium pile portion.

A method of producing the polyester-based fibers is not particularly limited. The polyester-based fibers can be produced in the same manner as usual polyester-based fibers except the steps described above. The polyester-based fibers can be produced by, e.g., melt kneading, using various general kneading machines, the polyester-based resin or a polyester-based resin composition obtained by dry blending the polyester-based resin and an additive agent, pelletizing the polyester-based resin or the polyester-based resin composition, and then melt spinning the resulting pellets. Melt spinning is performed while the temperatures (spinning temperatures) of, e.g., an extruder, a gear pump, and a spinneret are set to 250° C. or more and 300° C. or less. The obtained spun yarns are passed through a heated tube, then cooled to a temperature of not more than the glass transition point of the polyester-based resin, and wound up at a speed of 50 m/min or more and 4500 m/min or less to obtain spun yarns (undrawn yarns). The spun yarns (undrawn yarns) can be drawn through hot drawing. The heating means for the hot drawing may be, e.g., a heating roller, a heat plate, a steam jet apparatus, or a hot water bath, and they can be used in combination as appropriate.

Crimping can be performed by a known crimp imparting apparatus such as a gear crimper or a stuffing box crimper. Similarly to usual crimping, it is possible to crimp the polyester-based fibers in a state in which the polyester-based fibers are preheated to a temperature that is higher than or equal to a softening temperature. Similarly to usual crimping, preheating can be performed by wet heat, e.g., by steam at 85° C. or more and 110° C. or less.

In one or more embodiments of the present invention, the polyester-based fibers have a Young's modulus of preferably 4.0 GPa or more, and more preferably 5.0 GPa or more. This is because the higher the Young's modulus is, the higher the rigidity of the fibers is, and the better the voluminousness of the pile fabric is.

In one or more embodiments of the present invention, from the viewpoint of further improving the appearance, voluminousness, and compression recoverability, the pile fabric may include the short pile portion in an amount of 50% by weight or more and 95% by weight or less of the total weight of the pile portion and the long pile portion in an amount of 5% by weight or more and 50% by weight or less of the total weight of the pile portion, and the pile fabric may include the short pile portion in an amount of 60% by weight or more and 80% by weight or less of the total weight of the pile portion and the long pile portion in an amount of 20% by weight or more and 40% by weight or less of the total weight of the pile portion.

In one or more embodiments of the present invention, from the viewpoint of further improving the appearance, voluminousness, and compression recoverability, the pile fabric may include the short pile portion in an amount of 50% by weight or more and 95% by weight or less of the total weight of the pile portion, the medium pile portion in an amount of 30% by weight or less of the total weight of the pile portion, and the long pile portion in an amount of 5% by weight or more and 50% by weight or less of the total weight of the pile portion, and the pile fabric may include the short pile portion in an amount of 60% by weight or more and 80% by weight or less of the total weight of the pile portion, the medium pile portion in an amount of 30% by weight or less of the total weight of the pile portion, and the long pile portion in an amount of 20% by weight or more and 40% by weight or less of the total weight of the pile portion.

EXAMPLES

Hereinafter, one or more embodiments of the present invention will be specifically described by way of examples and comparative examples. Note that one or more embodiments of the present invention are not limited to these examples.

First, a measuring method and an evaluation method used in the examples and comparative examples will be described.

(Crimp Removal Temperature)

Polyester-based fibers were bundled to prepare a fiber bundle with 9000 dtex. Both ends of the fiber bundle were trimmed such that the resulting sample had a length of about 200 mm. The sample was suspended vertically in a hot-air convection dryer. A 36 g-weight was suspended from a lower end of the fiber bundle (a load of 4 mg/dtex was applied to the fiber bundle). In this state, the sample was subjected to heat treatment for 60 seconds at a predetermined temperature starting from 50° C. and increasing in increments of 10° C. After each instance of heat treatment, a length A of the fiber bundle under a load of 4 mg/dtex, and a length B of the fiber bundle under no load after the weight had been removed were measured. The measurement thereof was performed five times at each temperature. The differences between the values of A and B were divided by A, and the values thus obtained were averaged. Out of the temperatures, the minimum temperature at which the average was less than 3% was referred to as the "crimp removal temperature". That is, the crimp removal temperature indicates the minimum temperature that satisfies the following numerical formula (1).

$$(A-B)/A\times 100<3(\%) \quad (1)$$

(Crimp Removability)

The crimp removability of pile portions of a pile fabric was sensory evaluated based on the following five criteria. When the criterion of the crimp removability was 3, only crimps on a napped surface layer portion of the pile fabric were removed. From the viewpoint of achieve voluminousness, an appearance, and a feel, crimps may be left appropriately in a short pile portion, and the crimp removability of the short pile portion may be 3. From the viewpoints of an appearance and a feel, crimps may be removed neatly in a long pile portion, and the crimp removability of the long pile portion may be 5. The crimp removability of a medium pile portion may be 3 or 4.

5: The directions of pile fibers were aligned, and crimps were removed neatly from the roots to tips of the pile fibers.

4: The directions of pile fibers were aligned, and crimps were removed neatly up to middle portions of the pile fibers.

3: The directions of pile fibers were aligned, and crimps were removed neatly only from the tips of the pile fibers.

2: The directions of pile fibers were aligned, but crimps were not removed at all.

1: The directions of pile fibers were not aligned, and crimps were not removed at all.

(Voluminousness)

Figure 1B:
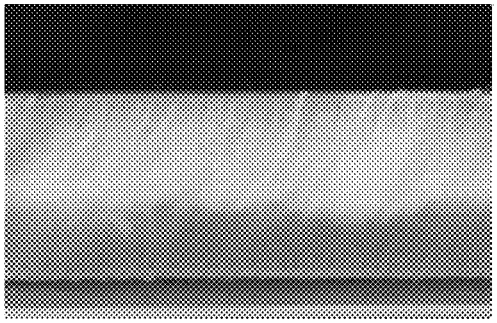
Figure 1C:
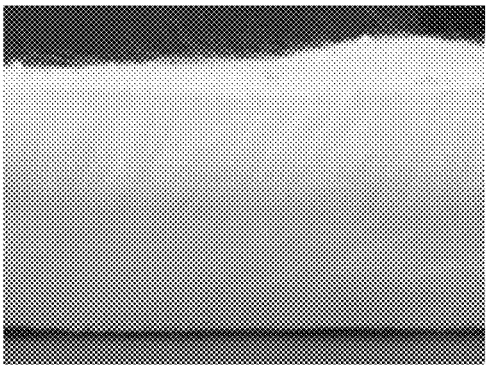
Figure 1D:
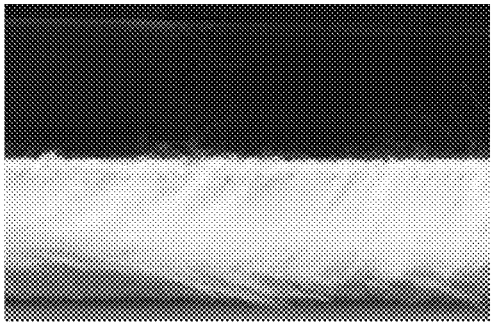

The voluminousness of a pile fabric was evaluated based on the following criteria. Reference photographs for the respective criteria are shown in FIGS. 1A-1D. Specifically, FIGS. 1A and 1B show reference photographs when a pile fabric had good voluminousness, and FIGS. 1C and 1D show reference photographs when a pile fabric had poor voluminousness.

Good: When napped portions of two pile fabrics were placed on each other and a pressure of 300 Pa was applied thereto, the thickness of the pile fabrics placed on each other was about 60% or more of the thickness of the pile fabrics obtained before the pressure was applied, and the pile fabrics had sufficient voluminousness.

Poor: When napped portions of two pile fabrics were placed on each other and a pressure of 300 Pa was applied thereto, the thickness of the pile fabrics placed on each other was less than about 60% of the thickness of the pile fabrics obtained before the pressure was applied, and the pile fabrics had insufficient voluminousness.

(Appearance)

A surface of a napped portion (pile portion) of a pile fabric was observed, and was sensory evaluated based on the following criteria.

Good: The surface of a pile fabric was observed to be smooth.

Poor: A pile fabric was observed to be split.

(Compression Recoverability)

A pile fabric was cut into a square with a weight of 53 g. The fabric piece thus obtained was packed into a 0.28 L columnar container and allowed to stand still at room temperature. After 24 hours, the fabric piece was taken out from the container. The compression recoverability of the fabric piece was evaluated based on the following criteria.

Good: The fabric piece before and after packing did not differ in appearance.

Poor: Any of the following conditions was observed in the fabric piece.

(1) The napped portion was bent.

(2) The napped portion was fallen and did not stand.

(3) The napped portion was observed to be split.

<Production of Polyester-Based Fibers (PET Fibers)>

(Raw Cotton 1A for a Pile Fabric)

Polyethylene terephthalate (PET; EFG-70 manufactured by Bell Polyester Products, Inc.) having an intrinsic viscosity (IV value) of 0.75 was spun into undrawn yarns having a single fiber fineness of 50 dtex by a usual spinning machine using a spinneret with 150 holes having a five finger shape in cross section at a speed of 180 m/min and a spinning temperature of 285° C. At this time, 100 parts by weight of PET was blended with 2 parts by weight of titanium oxide as a delustering agent and 0.5 parts by weight of melamine-modified silica. Next, the undrawn yarns were drawn by 500% in a uniform hot-air drawing machine set at 90° C. and immediately subjected to heat treatment while subjected to a 3% limited shrinkage in a uniform hot-air heat treatment machine set at 150° C. for one minute to obtain heat treated yarns. After the heat treated yarns were assembled to an appropriate fineness, the heat treated yarns were crimped through preheating at 98° C. by a stuffing box crimper. The yarns were subjected to heat treatment in a uniform hot-air dryer set at 100° C. for 30 minutes in a relaxed state in which the relaxation rate was 15% or less. Thus, crimped fibers having a single fiber fineness of 10 dtex and a five skewered-dumpling shape in cross section were obtained. Finally, the crimped fibers were cut to 51 mm to obtain a raw cotton 1A for a pile fabric. The raw cotton 1A had a crimp removal temperature of 100° C.

(Raw Cotton 1B for a Pile Fabric)

A raw cotton 1B for a pile fabric was obtained in the same manner as the raw cotton 1A for a pile fabric. However, spinning was performed using a spinneret with 200 holes having a Y shape in cross section at a winding speed of 220 m/min to obtain undrawn yarns having a single fiber fineness of 31 dtex. The draw ratio was set to 420%. The heat treatment temperature after crimping was set to 80° C. Thus, crimped fibers having a single fiber fineness of 7 dtex and a Y shape in cross section were obtained. Finally, the crimped fibers were cut to 51 mm to obtain the raw cotton 1B for a pile fabric. The raw cotton 1B had a crimp removal temperature of 90° C.

(Raw Cotton 1C for a Pile Fabric)

A raw cotton 1C for a pile fabric was obtained in the same manner as the raw cotton 1A for a pile fabric. However, spinning was performed using a spinneret with 80 holes having a cocoon shape in cross section at a winding speed of 150 m/min. Moreover, PET was blended with 2 parts by weight of titanium oxide, 0.5 parts by weight of modified silica, and 4 parts by weight of a brown pigment compound. Furthermore, the draw ratio was set to 415%. The heat treatment temperature after drawing and before crimping was set to 180° C. Heat treatment after crimping was not performed. Thus, crimped fibers having a single fiber fineness of 35 dtex and a cocoon shape in cross section were obtained. Finally, the crimped fibers were cut to 102 mm to obtain the raw cotton 1C for a pile fabric. The raw cotton 1C had a crimp removal temperature of 80° C.

(Raw Cotton 1D for a Pile Fabric)

Crimped fibers having a single fiber fineness of 10 dtex and a five skewered-dumpling shape in cross section were obtained in the same manner as in Example 1 except that the yarns were not subjected to heat treatment before crimping, but were subjected to heat treatment in a uniform hot-air dryer set at 150° C. for 30 minutes after crimping. A raw cotton 1D had a crimp removal temperature of 150° C.

(Raw Cotton 1E for a Pile Fabric)

A raw cotton 1E for a pile fabric was obtained in the same manner as the raw cotton 1A for a pile fabric. However, spinning was performed using a spinneret with 150 holes having a four finger shape in cross section at a winding speed of 400 m/min to obtain undrawn yarns having a single fiber fineness of 18 dtex. Moreover, the draw ratio was set to 400%. Heat treatment after crimping was performed for 15 minutes. Thus, crimped fibers having a single fiber fineness of 4.5 dtex and a four skewered-dumpling shape in cross section were obtained. Finally, the raw cotton 1E for a pile fabric was obtained. The raw cotton 1E had a crimp removal temperature of 100° C.

(Raw Cotton 1F for a Pile Fabric)

A raw cotton 1F for a pile fabric was obtained in the same manner as the raw cotton 1A for a pile fabric. However, spinning was performed using a spinneret with 35 holes having a five finger shape in cross section at a winding speed of 170 m/min. Moreover, PET was blended with 2 parts by weight of titanium oxide and 0.5 parts by weight of modified silica. Furthermore, the draw ratio was set to 510%. Heat treatment temperature after drawing and before crimping was set to 210° C. Heat treatment after crimping was not performed. Thus, crimped fibers having a single fiber fineness of 35 dtex and a five skewered-dumpling shape in cross section were obtained. Finally, the crimped fibers were cut to 102 mm to obtain the raw cotton 1F for a pile fabric. The raw cotton 1F had a crimp removal temperature of 80° C.

<Modacrylic Fibers>

(Modacrylic fibers 1)

Modacrylic fibers (trade name "Kanekalon (registered trademark) RCL" manufactured by Kaneka Corporation) having a softening point of 180° C. to 190° C., a fineness of 12 dtex, and a cut length of 76 mm were used (hereinafter, simply referred to as "RCL").

(Modacrylic Fiber 2)

Modacrylic fibers (trade name "Kanekalon (registered trademark) ELP" manufactured by Kaneka Corporation) having a softening point of 180° C. to 190° C., a fineness of 27 dtex, and a cut length of 102 mm were used (hereinafter, simply referred to as "ELP").

(Modacrylic Fiber 3)

Modacrylic fibers (trade name "Kanekalon (registered trademark) AH" manufactured by Kaneka Corporation) having a softening point of 180° C. to 190° C., a fineness of 3.3 dtex, and a cut length of 51 mm were used (hereinafter, simply referred to as "AH").

<Production of Pile Fabric>

Example 1

The raw cottons 1A, 1B, and 1C for a pile fabric thus obtained were used in a weight ratio of 50:20:30 to produce a sliver. The obtained sliver was knitted into a pile fabric by a sliver knitting machine. The raw cottons 1A and 1B were used for a short pile portion. The raw cotton 1C was used for a long pile portion. Next, pre-polishing was performed at 120° C., a back surface of the pile fabric was back-coated with an acrylic acid ester-based adhesive, and tentering was performed. Next, polishing was performed at 160° C. three times, at 130° C. three times, and at 100° C. three times. Thus, a pile fabric having a basis weight of about 1600 g/m$^2$ was obtained.

Example 2

A pile fabric having a basis weight of about 2000 g/m$^2$ was produced in the same manner as in Example 1 except that the raw cottons 1E and 1F for a pile fabric were used in a weight ratio of 70:30 as raw cottons for a pile fabric. The raw cotton 1E was used for a short pile portion. The raw cotton 1F was used for a long pile portion.

Comparative Example 1

A pile fabric having a basis weight of about 1730 g/m$^2$ was produced in the same manner as in Example 1 except that the raw cottons 1A and 1B for a pile fabric, RCL, and ELP were used in a weight ratio of 35:15:20:30 as raw cottons for a pile fabric, RCL was used for a medium pile portion, and ELP was used for a long pile portion.

Comparative Example 2

A pile fabric having a basis weight of about 1540 g/m$^2$ was produced in the same manner as in Example 1 except that the raw cotton 1D for a pile fabric and ELP were used in a weight ratio of 70:30 as raw cottons for a pile fabric, the raw cotton 1D was used for a short pile portion, and ELP was used for a long pile portion.

Comparative Example 3

A pile fabric having a basis weight of about 1540 g/m$^2$ was produced in the same manner as in Example 1 except that the raw cottons AK RCL, and ELP for a pile fabric were used in a weight ratio of 50:20:30 as raw cottons for a pile fabric, AH was used for a short pile portion, RCL was used for a medium pile portion, and ELP was used for a long pile portion.

In each of the examples and comparative examples, the crimp removability, appearance, compression recoverability, and voluminousness of the pile fabric thus obtained were evaluated as above. Table 1 indicates the results.

TABLE 1

| | | Mixing ratio in pile fabric (% by weight) | Type of fiber | Single fiber fineness (dtex) | Pile portion | Heat treatment condition of PET fiber: Before crimping ° C. × minute | Heat treatment condition of PET fiber: After crimping ° C. × minute | Crimp removal temperature of PET fiber (° C.) |
|---|---|---|---|---|---|---|---|---|
| Ex. 1 | Raw cotton 1A | 50 | PET fibers | 10 | Short pile portion | 150° C. × 1 minute | 100° C. × 30 minutes | 100 |
| | Raw cotton 1B | 20 | PET fibers | 7 | Short pile portion | 150° C. × 1 minute | 80° C. × 30 minutes | 90 |
| | Raw cotton 1C | 30 | PET fibers | 35 | Long pile portion | 180° C. × 1 minute | None | 80 |
| Ex. 2 | Raw cotton 1E | 70 | PET fibers | 4.5 | Short pile portion | 150° C. × 1 minute | 100° C. × 15 minutes | 100 |
| | Raw cotton 1F | 30 | PET fibers | 35 | Long pile portion | 210° C. × 1 minute | None | 80 |

| | | Fabric evaluation: Crimp removability | Pile length (mm): Short pile portion | Pile length (mm): Long pile portion | Difference | Appearance | Voluminousness | Compression recoverability |
|---|---|---|---|---|---|---|---|---|
| Ex. 1 | Raw cotton 1A | 3 | 38 | 65 | 27 | Good | Good | Good |
| | Raw cotton 1B | 3 | | | | | | |
| | Raw cotton 1C | 5 | | | | | | |
| Ex. 2 | Raw cotton 1E | 3 | 38 | 66 | 28 | Good | Good | Good |
| | Raw cotton 1F | 5 | | | | | | |

TABLE 1-continued

| | | Mixing ratio in pile fabric (% by weight) | Type of fiber | Single fiber fineness (dtex) | Pile portion | Heat treatment condition of PET fiber: Before crimping ° C. × minute | Heat treatment condition of PET fiber: After crimping ° C. × minute | Crimp removal temperature of PET fiber (° C.) |
|---|---|---|---|---|---|---|---|---|
| Comp. Ex. 1 | Raw cotton 1A | 35 | PET fibers | 10 | Short pile portion | 150° C. × 1 minute | 100° C. × 30 minutes | 100 |
| | Raw cotton 1B | 15 | PET fibers | 7 | Short pile portion | 150° C. × 1 minute | 80° C. × 30 minutes | 90 |
| | RCL | 30 | Modacrylic fibers | 12 | Medium pile portion | — | — | — |
| | ELP | 20 | Modacrylic fibers | 27 | Long pile portion | — | — | — |
| Comp. Ex. 2 | Raw cotton 1D | 70 | PET fibers | 10 | Short pile portion | None | 150° C. × 30 minutes | 150 |
| | ELP | 30 | Modacrylic fibers | 27 | Long pile portion | — | — | — |

| | | Fabric evaluation: Crimp removability | Pile length (mm): Short pile portion | Pile length (mm): Long pile portion | Pile length (mm): Difference | Appearance | Voluminousness | Compression recoverability |
|---|---|---|---|---|---|---|---|---|
| Comp. Ex. 1 | Raw cotton 1A | 3 | 37 | 67 | 30 | Good | Good | Poor |
| | Raw cotton 1B | 3 | | | | | | |
| | RCL | 4 | | | | | | |
| | ELP | 5 | | | | | | |
| Comp. Ex. 2 | Raw cotton 1D | 1 | 36 | 63 | 27 | Poor | Good | Poor |
| | ELP | 5 | | | | | | |

| | | Mixing ratio in pile fabric (% by weight) | Type of fiber | Single fiber fineness (dtex) | Pile portion | Heat treatment condition of PET fiber: Before crimping ° C. × minute | Heat treatment condition of PET fiber: After crimping ° C. × minute | Crimp removal temperature of PET fiber (° C.) |
|---|---|---|---|---|---|---|---|---|
| Comp. Ex. 3 | AH | 50 | Modacrylic fibers | 3.3 | Short pile portion | — | — | — |
| | RCL | 20 | Modacrylic fibers | 12 | Medium pile portion | — | — | — |
| | ELP | 30 | Modacrylic fibers | 27 | Long pile portion | — | — | — |

| | | Fabric evaluation: Crimp removability | Pile length (mm): Short pile portion | Pile length (mm): Long pile portion | Pile length (mm): Difference | Appearance | Voluminousness | Compression recoverability |
|---|---|---|---|---|---|---|---|---|
| Comp. Ex. 3 | AH | 3 | 31 | 58 | 27 | Good | Poor | Poor |
| | RCL | 3 | | | | | | |
| | ELP | 5 | | | | | | |

* Ex.: Example
* Comp. Ex.: Comparative Example

As understood from Table 1, all the crimp removability, appearance, voluminousness, and compression recoverability of the pile fabric were good in each of Examples 1 and 2 in which the PET fibers having a predetermined crimp removal temperature were used both for the long pile portion and for the short pile portion.

The crimp removability, appearance, and voluminousness of the pile fabric were good in Comparative Example 1 in which the PET fibers having a predetermined crimp removal temperature were used for the short pile portion and only modacrylic fibers RCL and ELP were used for the long pile portion. However, the compression recoverability of the pile fabric was poor in Comparative Example 1. The crimp removability of the short pile portion of the pile fabric was 1 in Comparative Example 2 in which the PET fibers having a crimp removal temperature of 150° C. were used for the short pile portion and crimps were not able to be removed in the pile fabric. As a result of this, the appearance and compression recoverability thereof were poor. The crimp removability and appearance were good, but the voluminousness and compression recoverability were poor in Comparative Example 3 in which the modacrylic fibers were used both for the long pile portion and for the short pile portion.

One or more embodiments of the present invention can be constituted as below.

[1] A pile fabric, including:

a pile portion that includes a long pile portion and a short pile portion, wherein an average pile length of the long pile portion differs from an average pile length of the short pile portion by 2 mm or more, the long pile portion contains crimped polyester-based fibers in an amount of 60% by weight or more, the short pile portion contains crimped polyester-based fibers in an amount of 60% by weight or more, a crimp removal temperature of the crimped polyester-based fibers of the long pile portion is lower than a crimp removal temperature of the crimped polyester-based fibers of the short pile portion, the crimp removal temperature of the crimped polyester-based fibers of the short pile portion is 90° C. or more and 120° C. or less, and each of the crimp removal temperatures indicates a minimum temperature that satisfies the following numerical formula (1):

$$(A-B)/A\times100<3(\%) \quad (1)$$

where, in the formula (1),

A represents a length of a fiber bundle of the crimped polyester-based fibers of the short pile portion under a load of 4 mg/dtex after the fiber bundle is subjected to dry heat treatment at a predetermined temperature for 60 seconds under a load of 4 mg/dtex, and B represents a length of the fiber bundle of the crimped polyester-based fibers of the short pile portion under no load after the fiber bundle is subjected to the dry heat treatment at the predetermined temperature for 60 seconds under a load of 4 mg/dtex.

[2] The pile fabric according to [1], wherein the crimp removal temperature of the crimped polyester-based fibers of the long pile portion is 90° C. or less.

[3] The pile fabric according to [1] or [2], wherein the short pile portion has a single fiber fineness of 1 dtex or more and 10 dtex or less.

[4] The pile fabric according to any of [1] to [3], wherein the long pile portion has a single fiber fineness of 10 dtex or more and 40 dtex or less.

[5] The pile fabric according to any of [1] to [4], wherein the pile fabric includes the short pile portion in an amount of 50% by weight or more and 95% by weight or less of a total weight of the pile portion and the long pile portion in an amount of 5% by weight or more and 50% by weight or less of the total weight of the pile portion.

[6] A method for manufacturing the pile fabric according to any of [1] to [5], including polishing at a temperature of 90° C. or more and 160° C. or less.

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

What is claimed:

1. A pile knitted fabric, comprising:

a knitted pile portion that comprises a long pile portion and a short pile portion, wherein an average pile length of the long pile portion differs from an average pile length of the short pile portion by 2 mm or more, the long pile portion comprises crimped polyester-based fibers in an amount of 60% by weight or more, the short pile portion comprises crimped polyester-based fibers in an amount of 60% by weight or more, a crimp removal temperature of the crimped polyester-based fibers of the long pile portion is lower than a crimp removal temperature of the crimped polyester-based fibers of the short pile portion, the crimp removal temperature of the crimped polyester-based fibers of the short pile portion is 90° C. or more and 120° C. or less, and each of the crimp removal temperatures indicates a minimum temperature that satisfies the following numerical formula (1):

$$(A-B)/A\times100<3(\%) \quad (1)$$

where, in the formula (1),

A represents a length of a fiber bundle of the crimped polyester-based fibers under a load of 4 mg/dtex after the fiber bundle is subjected to dry heat treatment at a predetermined temperature for 60 seconds under a load of 4 mg/dtex, and B represents a length of the fiber bundle of the crimped polyester-based fibers under no load after the fiber bundle is subjected to the dry heat treatment at the predetermined temperature for 60 seconds under a load of 4 mg/dtex.

2. The pile knitted fabric according to claim 1, wherein the crimp removal temperature of the crimped polyester-based fibers of the long pile portion is 90° C. or less.

3. The pile knitted fabric according to claim 1, wherein the short pile portion has a single fiber fineness of 1 dtex or more and 10 dtex or less.

4. The pile knitted fabric according to claim 1, wherein the long pile portion has a single fiber fineness of 10 dtex or more and 40 dtex or less.

5. The pile knitted fabric according to claim 1, wherein the pile knitted fabric comprises:

the short pile portion in an amount of 50% by weight or more and 95% by weight or less of a total weight of the knitted pile portion; and the long pile portion in an amount of 5% by weight or more and 50% by weight or less of the total weight of the knitted pile portion.

6. A method for manufacturing the pile knitted fabric according to claim 1, comprising polishing at a temperature of 90° C. or more and 160° C. or less.

7. The method according to claim 6, wherein the crimp removal temperature of the crimped polyester-based fibers of the long pile portion is 90° C. or less.

8. The method according to claim 6, wherein the short pile portion has a single fiber fineness of 1 dtex or more and 10 dtex or less.

9. The method according to claim 6, wherein the long pile portion has a single fiber fineness of 10 dtex or more and 40 dtex or less.

10. The method according to claim 6, wherein the pile knitted fabric comprises:

the short pile portion in an amount of 50% by weight or more and 95% by weight or less of a total weight of the knitted pile portion; and the long pile portion in an amount of 5% by weight or more and 50% by weight or less of the total weight of the knitted pile portion.

11. The pile knitted fabric according to claim 1, wherein the long pile portion comprises:

the crimped polyester-based fibers in an amount of 60% by weight or more and 100% by weight or less; and a modacrylic fiber in an amount of 40% by weight or less.

12. The pile knitted fabric according to claim 1, wherein the crimped polyester-based fibers of the long pile portion and the short pile portion each comprise a cross-sectional shape comprising at least one selected from the group consisting of Y shapes, cocoon shapes, four skewered-dumpling shapes, and five skewered-dumpling shapes.

13. The method according to claim 6, wherein the long pile portion comprises:

the crimped polyester-based fibers in an amount of 60% by weight or more and 100% by weight or less; and a modacrylic fiber in an amount of 40% by weight or less.

14. The method according to claim 6, wherein the crimped polyester-based fibers of the long pile portion and the short pile portion each comprise a cross-sectional shape comprising at least one selected from the group consisting of Y shapes, cocoon shapes, four skewered-dumpling shapes, and five skewered-dumpling shapes.

15. The pile knitted fabric according to claim 1, wherein the crimp removal temperature of the crimped polyester-based fibers of the long pile portion differs from the crimp removal temperature of the crimped polyester-based fibers of the short pile portion by 10° C. or more.

16. The pile knitted fabric according to claim 1, wherein the crimped polyester-based fibers of the short pile portion comprise a cross-sectional shape comprising at least one selected from the group consisting of Y shapes and cocoon shapes.

* * * * *